United States Patent [19]

Lopez

[11] Patent Number: 4,671,450

[45] Date of Patent: Jun. 9, 1987

[54] COLLAPSIBLE CARTON

[75] Inventor: Louis Lopez, Leominster, Mass.

[73] Assignee: Corrugated Paper Corporation, Westboro, Mass.

[21] Appl. No.: 869,407

[22] Filed: Jun. 2, 1986

[51] Int. Cl.[4] ..... B65D 5/48

[52] U.S. Cl. ..... 229/27; 229/28 R; 229/41 R; 229/117

[58] Field of Search ..... 229/15, 27, 28 R, 42, 229/28 BC, 117, 41 R, 41 B, 29 D; 217/30–32; 206/170–173, 180–191

[56] References Cited

U.S. PATENT DOCUMENTS

| | | | |
|---|---|---|---|
| 2,712,882 | 7/1955 | Buttery et al. | 229/28 BC |
| 2,909,311 | 10/1959 | Levitt | 229/28 R |
| 3,006,529 | 10/1961 | Richardson | 229/28 R |
| 3,145,903 | 8/1964 | Franklin, Jr. | 229/15 |
| 3,184,143 | 5/1965 | Kotowick | 229/41 B |
| 4,114,796 | 9/1978 | Voges | 229/27 |
| 4,347,967 | 9/1982 | Loudermilk, Jr. | 229/15 |

FOREIGN PATENT DOCUMENTS

| | | | |
|---|---|---|---|
| 480197 | 1/1952 | Canada | 229/28 BC |

*Primary Examiner*—William Price
*Assistant Examiner*—Gary E. Elkins
*Attorney, Agent, or Firm*—Blodgett & Blodgett

[57] ABSTRACT

Carton capable of being collapsed to flat condition and having a substantial number of dividers to separate the contents, which dividers are constructed of double thickness to provide vertical strength and allow substantial stacking.

4 Claims, 16 Drawing Figures

FIG. 11
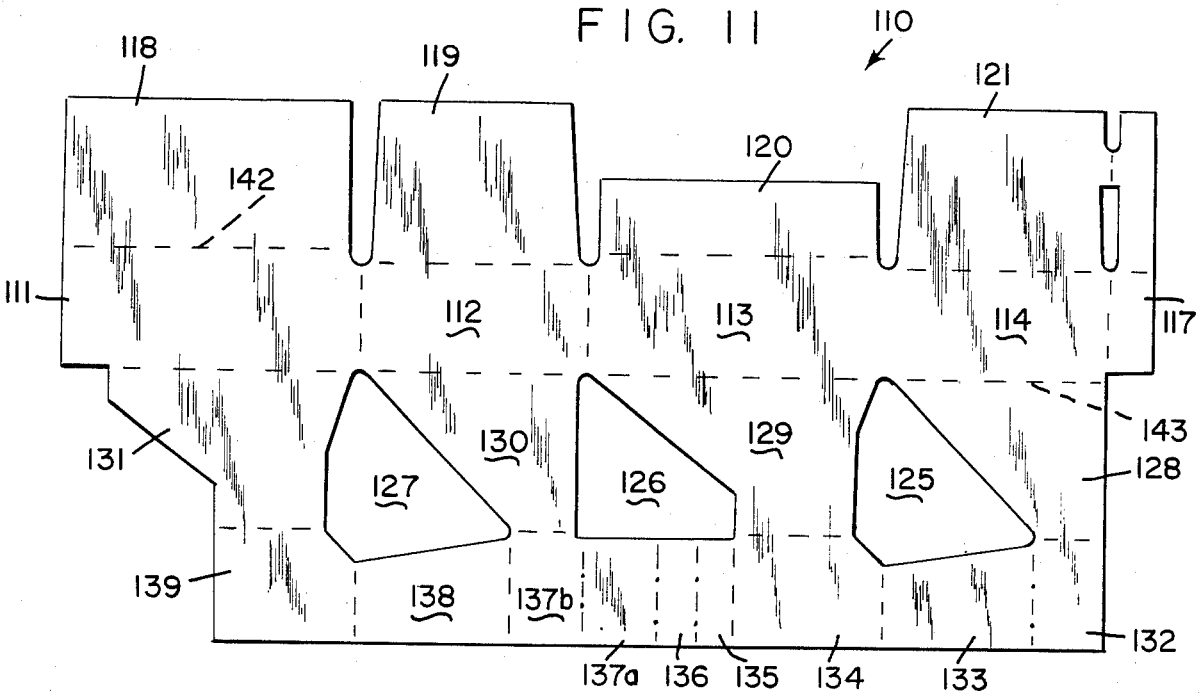
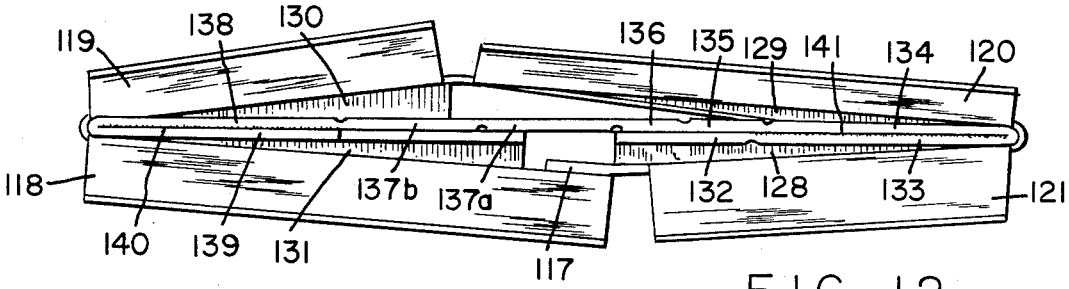
FIG. 12
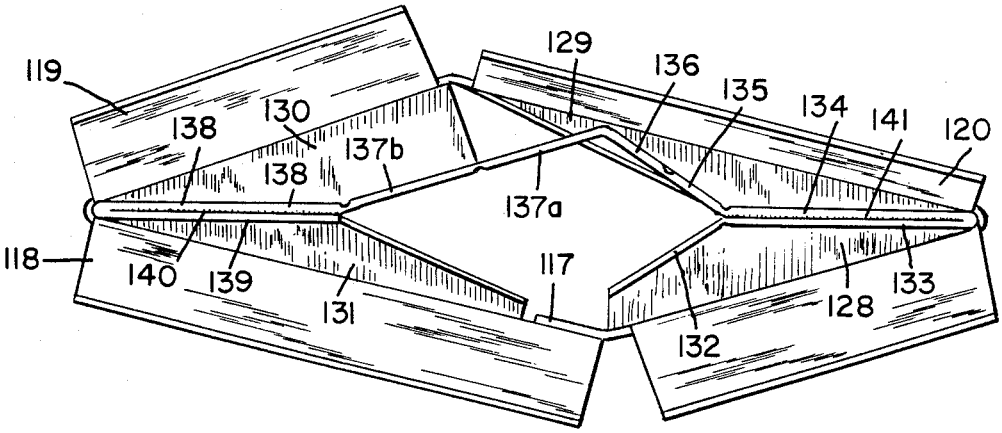
FIG. 13

COLLAPSIBLE CARTON

BACKGROUND OF THE INVENTION

In the design and construction of a container for the shipment of articles, such as glass jars and the like, there are a number of functions which need to be supplied in connection with a modern carton of this type. First of all, it is desirable that the carton be made from a single piece of board on automatic machinery. Furthermore, particularly in the case of corrugated board cartons, it is desirable that the carton be completely collapsible to a flat condition for return shipment or for storage before the contents are placed in the carton. Furthermore, since the carton containing the product needs to be stacked not only at the factory where the contents are manufactured, but also at the place of distribution or retail sale, it is important that the carton have considerable vertical strength. The greater the strength the less likelihood of the carton collapsing and injuring the contents. In addition, when the carton is sufficiently strong, it is possible to stack more cartons one on top of another without undesirable damage or collapsing. Collapsible cartons manufactured in the past, have been provided with dividers made of a single thickness of corrugated board and the strength of the carton has been less than would be desirable. Furthermore, in some cases the dividers are removable and then are not only are easily lost but difficult to store. Also, when the dividers are separately manufactured and inserted into the carton, it is not possible to manufacture the completed article on a modern straight-through corrugated board converting machine. These and other difficulties experienced with the prior art devices have been obviated in a novel manner by the present invention.

It is, therefore, an outstanding object of the invention to provide a collapsible carton having dividers in which the entire carton, including the dividers, is manufactured from a single sheet of corrugated board.

Another object of this invention is the provision of a carton which can be completely collapsed to flat condition or quickly erected into an assembled carton for the insertion of contents.

A further object of the present invention is the provision of a carton having dividers which not only serve to separate the articles contained in the carton but also provide considerable vertical strength.

It is another object of the instant invention to provide a collapsible carton which can be erected with a single hand movement and in which the dividers have a considerable portion formed with a double wall thickness, while still being constructed from a single sheet of corrugated board.

A still further object of the invention is the provision of a collapsible carton having a double wall thickness in the dividers, which carton can be manufactured on a continuous modern corrugated box machine.

It is a further object of the invention to provide a collapsible carton which can be manufactured with a minimum of gluing and folding operations.

With these and other objects in view, as will be apparent to those skilled in the art, the invention resides in the combination of parts set forth in the specification and covered by the claims appended hereto.

SUMMARY OF THE INVENTION

In general, the invention consists of a collapsible carton formed from a single blank of corrugated board which carton has four vertical walls defining a rectangular tray, has bottom panels defining the bottom of the tray, and has flaps defining a cover for the tray. Divider elements extend upwardly from the bottom of the tray, the divider elements consisting of a central divider and two lateral dividers separating the tray into four cells, one lateral divider extending at a right angle to the central divider at a one-third point of the length of the central divider and the other lateral divider extending at a right angle to the central divider at the two-thirds point of the length of the central divider in the opposite direction. A substantial portion of the dividers are provided with a double thickness of corrugated board.

More specifically the divider elements are defined by an elongated divider panel which is divided into a series of light divider elements by hinge lines, the second and third divider elements in the series being joined by glue to form a double member and the seventh and eighth divider elements being joined by glue to form a double member, and the fifth and sixth divider elements lying in juxtaposition to form an unglued double member.

BRIEF DESCRIPTION OF THE DRAWINGS

The character of the invention, however, may be best understood by reference to one of its structural forms, as illustrated by the accompanying drawings, in which:

FIG. 11 is a plan view of the inside surface of a blank from which the carton of FIG. 9 is manufactured, and FIGS. 12, 13, 14, 15, and 16 show various stages of erection of the collapsible carton from the folded or collapsed condition of FIG. 12 to the fully assembled condition of FIG. 9.

DESCRIPTION OF THE PREFERRED EMBODIMENT

Figure 1:
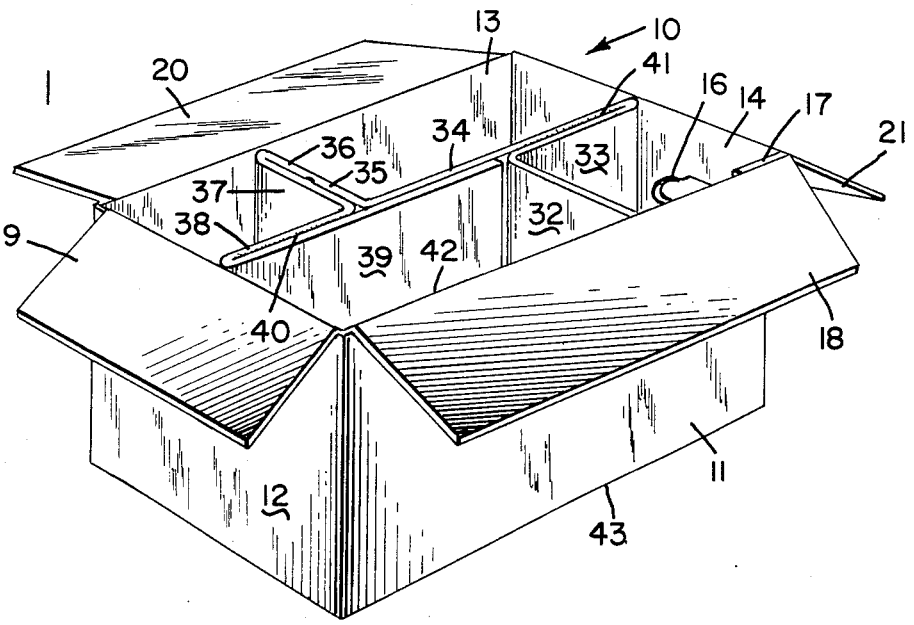
FIG. 1 is a perspective view of a collapsible carton embodying the principles of the present invention.
Figure 2:
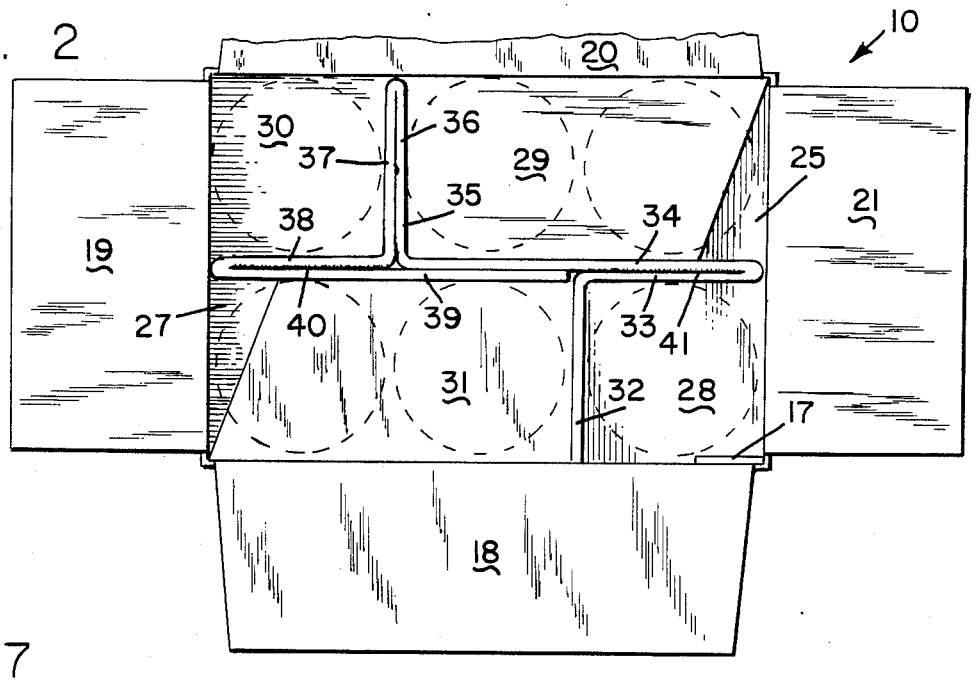
FIG. 2 is a top plan view of the carton.
Figure 3:
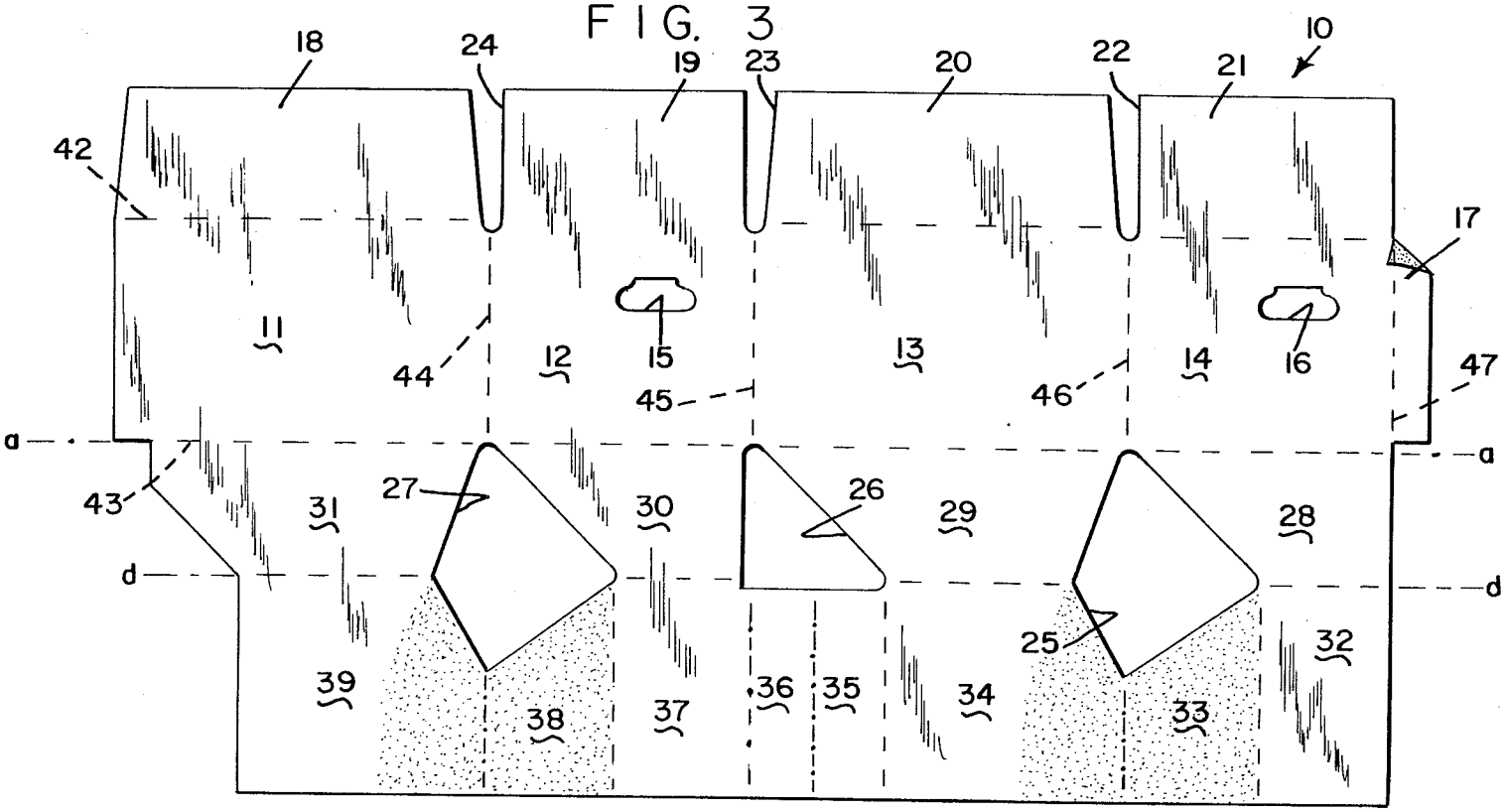
FIG. 3 is a plan view of the inside surface of a blank from which the collapsible carton is formed.

Referring first to FIGS. 1, 2, and 3, which best show the general features of the invention, it can be seen that the carton, indicated generally by the reference numeral 10, shows the type of carton that is intended to be collapsible and which is made from a single sheet of corrugated board. The carton is provided with four vertical walls 11, 12, 13 and 14 which are joined to form a rectangular tray having upper and lower edges. Vertical wall 12 is provided with a hand hole 15, while the vertical wall 14 is provided with a similar hand hole 16. The vertical edge of the end wall 14 is provided with a glue flap 17. The upper edges 42 of the vertical walls are formed with cover flaps. The vertical wall 11 is provided with a cover flap 18, the vertical wall 12 is provided with a cover flap 19, the vertical wall 13 is provided with a cover flap 20, and the vertical wall 14 is provided with a cover flap 21. The flaps are defined by notches 22, 23, and 24. The blank of corrugated board from which the carton is formed, is provided with apertures 25, 26, and 27, as is evident in FIG. 3. The bottom panels are hingedly connected to the lower edges 43 of each vertical wall. These bottom panels are foldable inwardly to form a bottom wall for the tray. The bottom wall 28 is hingedly attached to the bottom edge of the vertical wall, the bottom panel 29 is hingedly attached to the vertical wall 13, the bottom wall 30 is hingedly attached to the vertical wall 12, and the bottom wall 31 is hingedly attached to the vertical wall 11. The aperture 25 separates the bottom panel 28 from the bottom panel 29 and the aperture 26 separates the bottom panel 29 from the adjacent bottom panel 30, while the aperture 27 separates the bottom panel 30 from the bottom panel 31. All four bottom panels are of trapezoidal shape with the longer base connected to its respective vertical wall.

A divider element is hingedly connected to that edge of each trapezoidal bottom panel which is opposite the longer base. The divider strip is foldable upwardly to provide dividers overlying the bottom wall. One portion of the divider extends entirely across the enclosure or tray midway between two vertical walls. A second divider extends laterally of the said one divider to a third vertical wall and a third divider extends laterally of the said one divider to a fourth vertical wall at a position substantially removed from the second divider. A substantial portion of the divider consists of double thicknesses of board either glued together. As is evident in FIG. 2, the dividers consist of five portions at least three of which are of double thickness.

Referring next to FIG. 3, which shows the blank from which the carton is formed, it can be seen that the divider strip is hingedly connected to the bottom panel strip along a hinge line d—d. This strip is divided by lateral hinge lines into eight panels 32, 33, 34, 35, 36, 37, 38 and 39. The aperture 25 lies between the divider elements 33 and 34, the aperture 26 lies between the divider element 34 and the divider element 37, and serves to bracket the divider elements 35 and 36. Finally, the aperture 27 lies between the divider elements 38 and 39.

Figure 4:
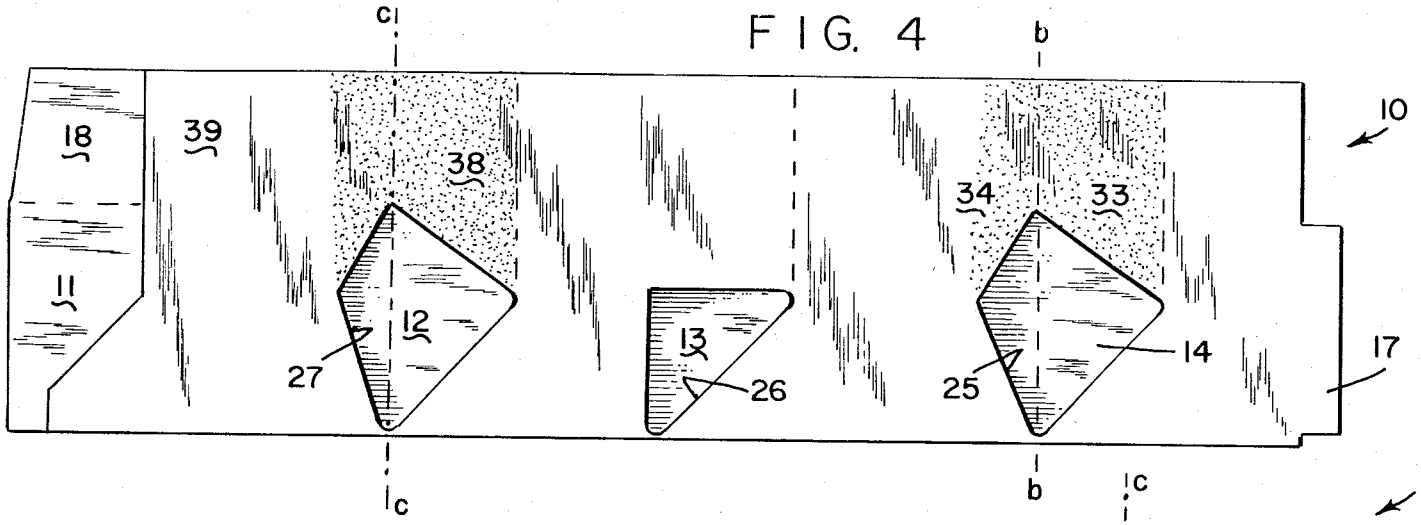

The formation of the carton in a corrugated board box manufacturing machine involves introducing the blank of FIG. 3 lengthwise into the machine in the position shown in FIG. 3. At that time, the blank is bent about the hinge line a—a which is a hinge between the vertical walls 11, 12, 13, and 14 (on the one hand) and the bottom panels 28, 29, 30, and 31 (on the other hand). The blank then takes the form shown in FIG. 4. Following that, glue is applied to the divider element 33 and the divider element 38. In FIG. 3 the blank is shown with the inner surface facing up, when the folding step about the line a—a has been completed; the outer surface of the bottom panel strip and the divider element strip faces up. Of course, the inner surface of the vertical walls and the cover flaps can be observed through the apertures 25, 26, and 27.

Figure 5:
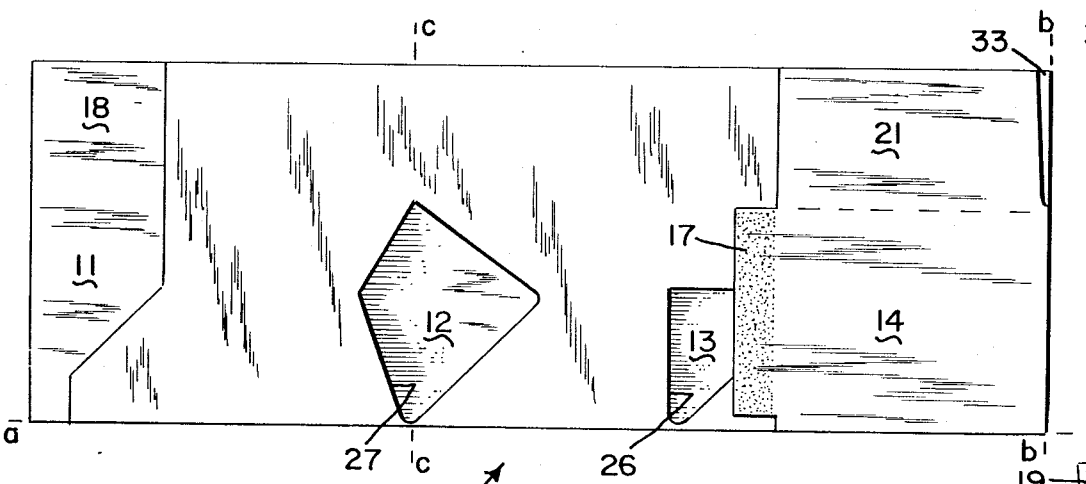

The next step is shown in FIG. 5 in which the blank is folded about the hinge line B—B thus resulting in the appearance shown in FIG. 5. The outer surface of the vertical wall 14 and of the cover flap 21 face upwardly as does the outer surface of the glue flap 17. The next step is to apply glue to the glue flap 17, as shown in the lined area. Folding of the blank about the fold line b—b causes the glued panel 33 to contact the adjacent panel 34 to fasten them together.

Figure 6:
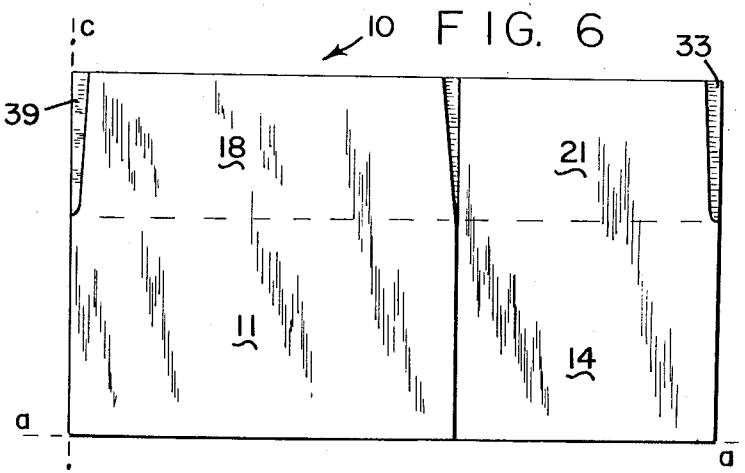

The next step is shown in FIG. 6 in which the left side of the blank is folded over about the hinge line c—c, thus causing the outer surface of the cover flap 18 and of the vertical wall 11 to face upwardly. It also causes the edge of the vertical wall 11 to contact the previously-glued panel 17 thus locking the vertical walls 11, 12, 13, and 14 together so that they may be erected to form a four-wall rectangular tray.

Figure 7:
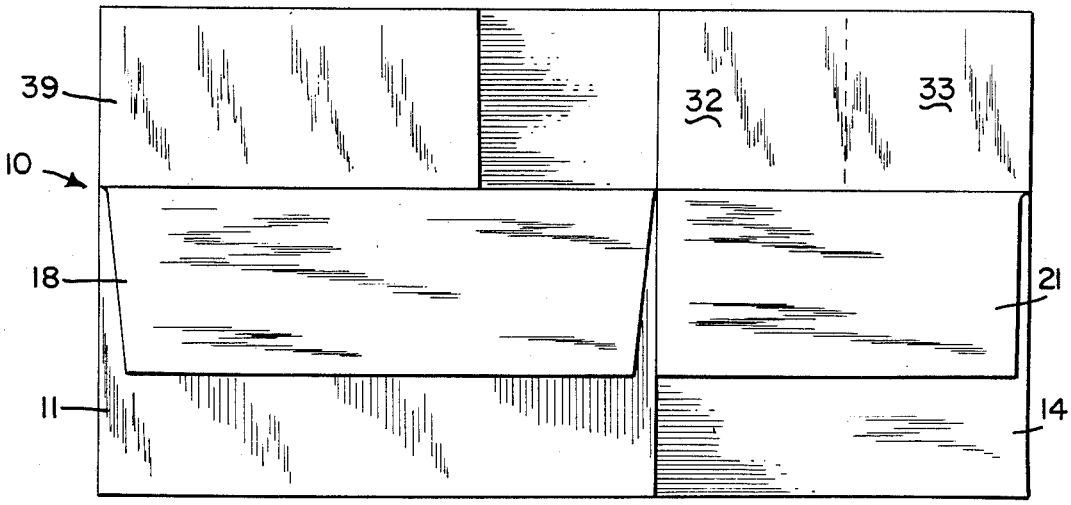
FIGS. 4, 5, 6, 7, and 8 are views showing the various steps in the manufacture of the carton.

Referring to FIG. 7, it can be seen that if the cover flaps 18 and 21 are bent downwardly to rest against the vertical wall 18 and 14, respectively, the divider elements are exposed. Referring back to FIG. 6, it will be recalled that, when the blank is folded about the hinge line c—c, the glued divider panel 38 contacts its adjacent panel 39 to fasten them together. Referring to FIG. 7, if the cover flap 20 and 19 folded about the upper edge 42 of the vertical walls 12 and 13 to which they are hingedly attached, the entire divider elements are exposed. By grasping the divider panel 33 with its fastened panel 34 with the right hand and grasping the panel 39 with its fastened panel 38 with the left hand, it is possible (by moving the two together and pressing downwardly) to assemble the carton so that it reaches the erected condition shown in FIG. 1. The clarity of presentation, the glue between the divider panels 33 and 34 is indicated by the reference numeral 41 while the glue between the divider panels 39 and 38 is shown by the reference numeral 40.

Figure 8:
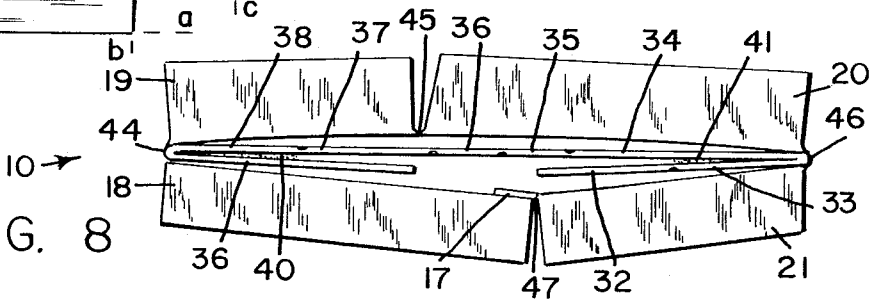

It can be seen, then, that the present invention (as described above) involves a carton having dividers, which carton is collapsible into the condition shown in FIGS. 7 and 8. Observing the appearance of the carton in collapsed condition from the top, it can be kept in mind that the hinge line between the vertical panel 11 and the vertical wall 12 has been given the reference numeral 44, while the hinge line between the vertical wall 12 and the vertical wall 13 has been given the reference numeral 45. The hinge line between the vertical wall 13 and the vertical wall 14 has been given the reference numeral 46 and the hinge line between the vertical wall 14 and the vertical wall 11 has been given the reference numeral 47.

From the above description, it can be seen that the carton has evolved into the collapsible carton shown in FIG. 1 by suitable folding and gluing of the blank shown in FIG. 3. When collapsed, the carton has the appearance from one side shown in FIG. 7 and from above the appearance shown in FIG. 8. In erected condition, FIG. 2 shows the appearance of the carton. It is, therefore, readily erected or assembled simply by suitable pulling and pushing of the dividers, which operation serves not only to assemble the tray, but also to settle the bottom panels and the divider elements into the tray. Considerable vertical strength is provided, as is obvious in FIG. 2, by the fact that not only is the staggered construction conducive to greater distribution of the load, but the provision of several double-walled portions provides greater strength. The glued portions 33 and 34 joined by the glue 41 provides one double-walled weight-bearing divider. A similar weight-bearing structure is provided by the panels 38 and 39 which are joined by the glue 40. The panels 35 and 36 combine with the panel 34 form a double-walled unglued portion. Furthermore, a substantial portion of the divider panels 39 and 34 overlap and form a central double wall portion which also adds to the vertical weight-bearing capacity of the carton. This weight is further distributed by folding the cover flaps 18, 19, 20, and 21 downward over the top of the container to provide a double wall in that position and distribute the load over the entire top of the dividers. The strength obtained in this manner is substantially greater than that provided by the prior art cartons of this type. Furthermore, the carton is easily collapsed or erected as desired by simple movements with the divider elements. In this way, when the carton is not in use, it can be stored in a limited space in a flat condition and yet can be instantly erected for the insertion of articles, which in the drawings are shown as jars or cans of product. Furthermore, it will be noted that the carton can be rapidly folded and glued on a conventional corrugated board box manufacturing machine by simple operations to form the finished product shown in FIGS. 7 and 8 which is ready for use. In the finished condition, it is in the collapsed form which means that it can be easily shipped to the point of use and occupies very little volume during that shipping.

Figure 9:
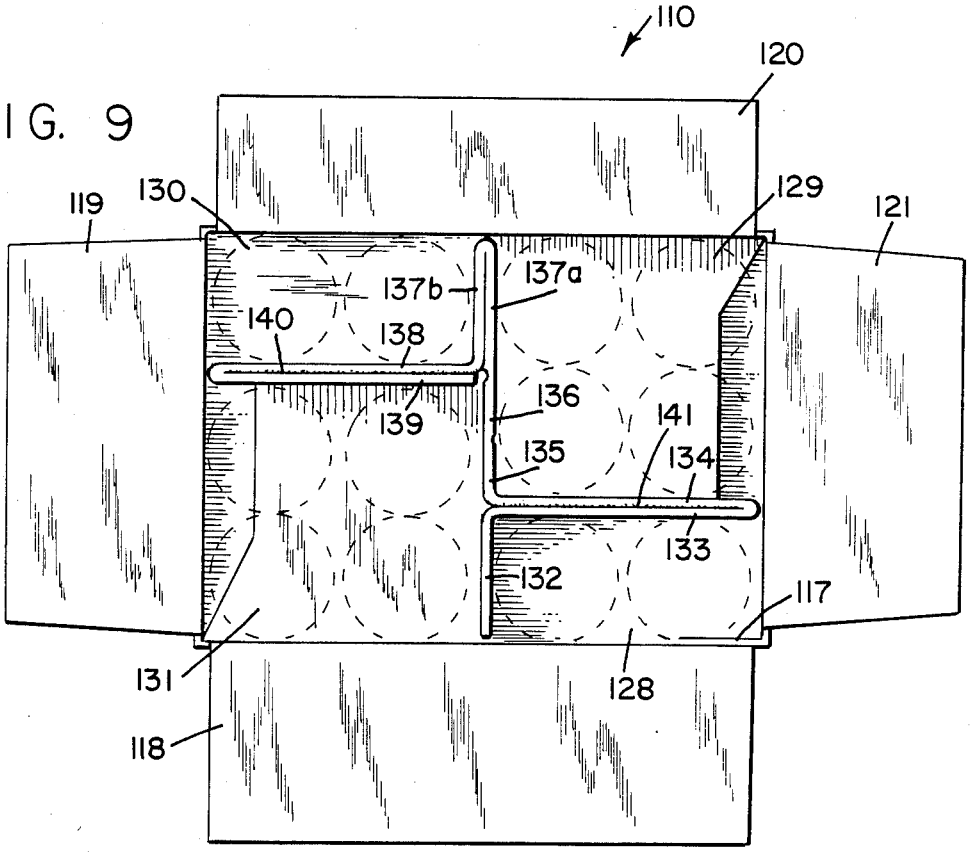
FIG. 9 is a plan view of a collapsible carton in a modified form.
Figure 10:
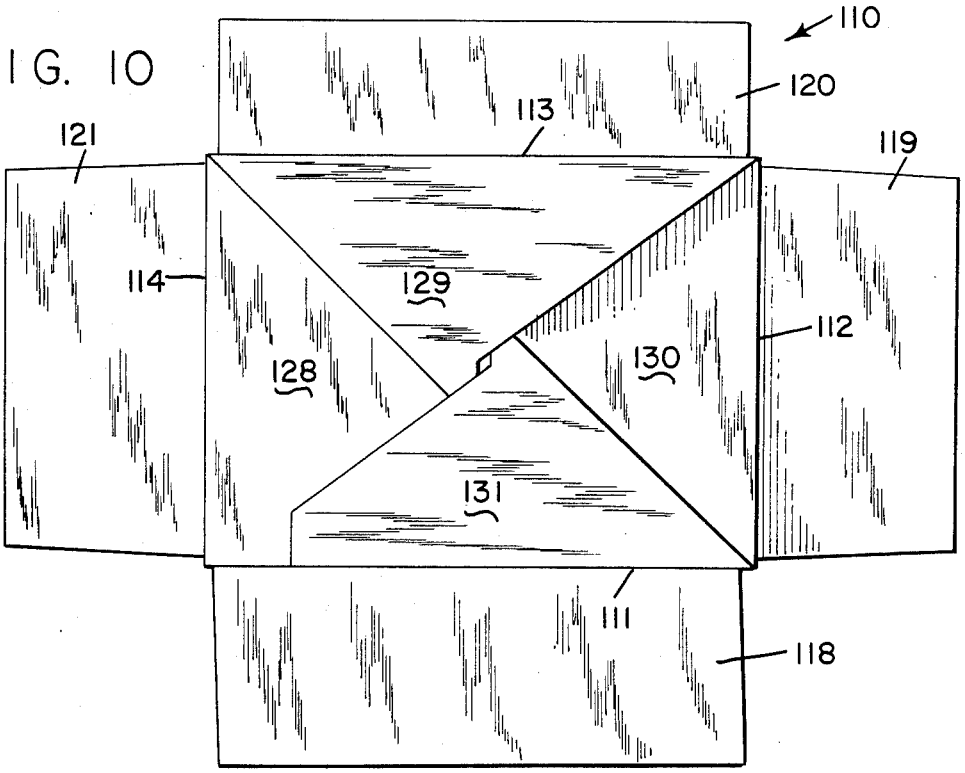
FIG. 10 is a bottom plan view of the last named carton.

A modified form of the invention is shown in FIGS. 9, 10, and 11 where the intent is to provide a collapsible carton 110 intended for use in storing and shipping twelve cylindrical articles, rather than the six cylindrical articles indicated in FIG. 2 of the previous embodiment. The carton 110 is formed from a single blank (shown in FIG. 11) of corrugated board. It consists of four vertical walls 111, 112, 113, and 114 defining a rectangular tray. A glued flap 17 serves to join the four vertical walls to form a tray, while hand holes 115 and 116 are formed in the vertical walls 112 and 114, respectively. Cover flaps 118, 119, 120, and 121 are suitably hinged to the upper edges of the vertical walls 111, 112, 113, and 114, respectively, to form a cover for the tray. The cover flaps are defined by notches 122, 123, and 124. The blank is provided with apertures 125, 126, and 127, separating, and dividing, as well as defining, bottom panels 128, 129, 130 and 131, the bottom panels serving as the bottom of the tray. Divider elements extend upwardly from the bottom of the tray. The divider elements, evident in FIG. 1, consist of a central divider and two lateral dividers separating the tray into four cells. One lateral divider extends at a right angle to the central divider at the $\frac{1}{3}$ point in the length of the central divider, while the other lateral divider extends at a right angle to the central divider at the $\frac{2}{3}$ point in the length of the central divider. It is obvious from the drawing that a substantial portion of the dividers is provided with a double thickness of corrugated board.

As is evident in FIG. 11, there are several divider elements 132, 133, 134, 135, 136, 137*a*, 137*b*, 138, and 139. A glue layer 140 lies between the divider panels 139 and the divider panel 138, while a similar glue layer 141 extends between the divider panels 133 and the divider panel 134. Assembly of the blank into the carton takes place in the manner previously described in connection with the carton shown in FIG. 1.

FIG. 10 shows the manner in which the trapezoidal shaped bottom panels slide over one another to form the bottom of the tray.

When the blank has been formed into the assembled carton in collapsed condition shown in FIG. 12, it is possible to demonstrate the manner in which the carton is erected. Referring first to FIG. 12, the portions of the panels 133 and 134 which have the glue layer 141 between them is grasped in the right hand, while the portions of the panels 139 and 138 which have the glue layer 140 between them is grasped in the left hand. With the bottom edges of the walls 111, 112, 113, 114 resting on a horizontal surface in front of the operator, the portions thus described are pushed toward one another and somewhat downwardly. This begins to spread the divider elements as shown in FIG. 13 and also force the bottom panels 128, 129, 130, and 131 downwardly toward the positions they will eventually occupy in the finished carton as shown in FIG. 10. This condition is evident in FIG. 13 as the two glued portions move toward one another; the panel 137*b* swings counterclockwise while the panel 132 swings counterclockwise also. This carries the three panels 135, 136, and 137*a* up in a counterclockwise direction.

Figure 14:
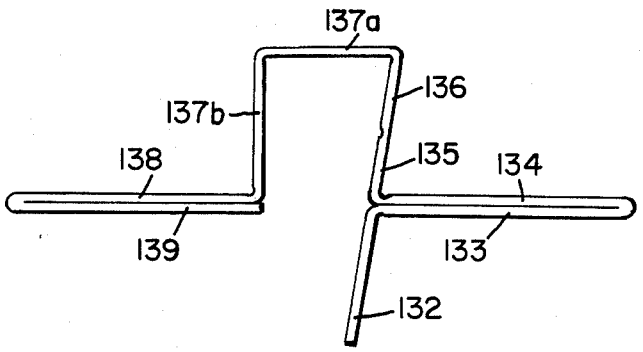
Figure 15:
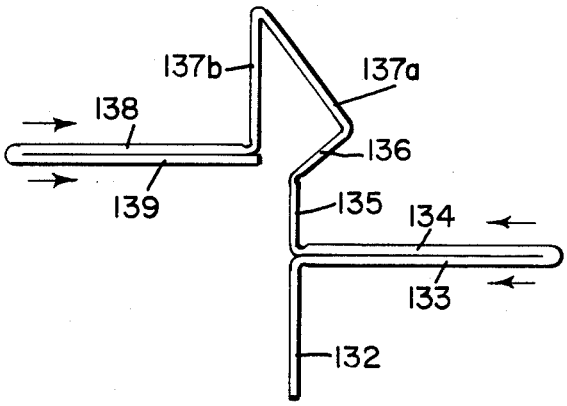
Figure 16:
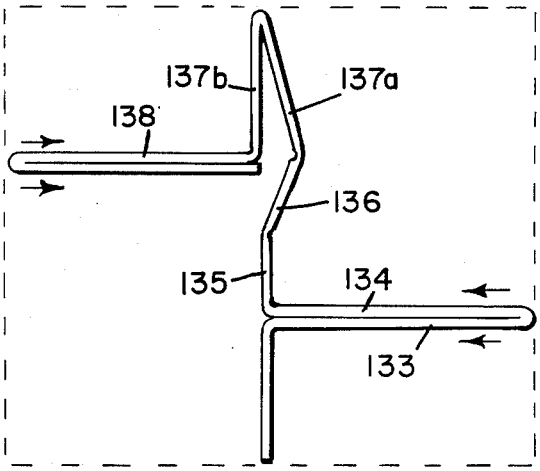

In FIG. 14, the motion is continued and the hinge line between the divider panels 135 and 136 breaks and allows an angle to exist between the panel 136 and 137*a* as shown in the drawing. Further movement carries the elements into the condition shown in FIG. 15, which, when continued, is shown in FIG. 16 as very close to the finished condition. Further movement of the parts causes the bottom panels to move downwardly into the plane of the bottom edges of the vertical walls to form the bottom as shown in FIG. 10, while the divider takes the final position shown in FIG. 9.

As shown best in FIG. 9, the divider occupies a strengthening condition similar to that as shown in FIG. 2, which shows the first version of the carton. The two lateral arms of the divider, provided by the panels 139 and 138 (on the one hand) and the panels 133 and 134 (on the other hand) are glued together and show a double thickness extending lengthwise of the carton. The double area formed by the panel 137*b* on the one hand, and the panels 137*a* and 136 on the other hand, lend a strengthening in the transverse direction. In this way, a substantial portion of the divider elements are formed with double thickness of corrugated board and serve to increase the thickness tremendously. The use of the staggered lateral branches serves to distribute the load over the entire area of the tray and, when these are covered by the cover flaps 118, 119, 120, and 121, the weight from above is well distributed. This allows the cartons filled with product to be stacked to a greater height without danger of collapse. A collapsed carton would cause the stack to lean over or fall, thus damaging the product. A smaller stack, of course, means that a given amount of cartons and product occupies a greater area in the storage place.

It can be seen, therefore, that the advantages of the present invention are carried out in both forms of the invention. The advantages of collapsibility, formation on standard machinery, and the use of a single blank is carried throughout both versions.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Collapsible carton formed from a single blank of corrugated board, comprising:

(a) four vertical walls defining a rectangular tray, (b) bottom panels defining a bottom of the tray, (c) flaps defining a cover for the tray, and (d) divider elements extending upwardly from the bottom of the tray, the divider elements consisting of a central divider and two lateral dividers separating the tray into four cells, one lateral divider extending at a right angle to the central divider at one-third of the length of the central divider and the other lateral divider extending at a right angle to the central divider at two-thirds of the length of the central divider, wherein a substantial portion of the dividers are provided with a double thickness of corrugated board, wherein the divider elements are defined by an elongated divider panel divided into a series of eight divider elements by hinge lines, the second and third divider elements in the series being joined by glue to form a double member, the seventh and eighth divider elements being joined by glue to form a double member, and the fifth and sixth divider elements lying in unglued juxtaposition to form a double member.

2. Collapsible carton as recited in claim 1, wherein the divider elements are arranged in a geometric figure consisting of a central straight line extending between two opposite vertical walls and midway between the other two opposite vertical walls and consisting of two lateral straight lines extending in opposite directions from the central line at right angles to one of the said other opposite vertical walls, one of the lateral lines being located at the one-third point of the length of the central line and the other lateral line being located at the two-thirds point of the length of the central line.

3. Collapsible carton as recited in claim 2, wherein the central line is formed in the first one-third portion and the third of one-third portion of its length as two thicknesses of corrugated board glued together, one of the lateral lines is formed of two thicknesses of corrugated board lying in juxtaposition, and the central one-third portion is formed of two thicknesses of corrugated board lying in juxtaposition.

4. Collapsible carton as recited in claim 2, wherein both lateral lines are formed of two thicknesses of corrugated board glued together, and wherein the first one-third portion of the central line is formed of two thickneses of corrugated board lying in juxtaposition.

* * * * *